US007386902B2

(12) United States Patent
Wilson

(10) Patent No.: US 7,386,902 B2
(45) Date of Patent: Jun. 17, 2008

(54) PILLOW WITH BREASTS

(76) Inventor: Juanita M. Wilson, 13502 Hoffman Ct., Bowie, MD (US) 20715-6024

( * ) Notice: Subject to any disclaimer, the term of this patent is extended or adjusted under 35 U.S.C. 154(b) by 98 days.

(21) Appl. No.: 11/355,084

(22) Filed: Feb. 16, 2006

(65) Prior Publication Data

US 2007/0094799 A1 May 3, 2007

Related U.S. Application Data

(60) Provisional application No. 60/596,890, filed on Oct. 27, 2005.

(51) Int. Cl.
*A47G 9/10* (2006.01)

(52) U.S. Cl. ..... 5/655; 5/639; 248/102; D6/599

(58) Field of Classification Search ..... 5/636, 5/639, 640, 645, 655; 248/102; D6/599, D6/601

See application file for complete search history.

(56) References Cited

U.S. PATENT DOCUMENTS

| | | | | |
|---|---|---|---|---|
| 2,409,820 | A * | 10/1946 | Zimmern | 215/12.1 |
| 3,112,837 | A | 12/1963 | Manoyian | |
| D237,569 | S | 11/1975 | De Rue | |
| 4,227,270 | A | 10/1980 | Rivera | |
| 4,776,546 | A * | 10/1988 | Goldson et al. | 248/102 |
| 4,809,938 | A * | 3/1989 | Skinner et al. | 248/102 |
| 4,895,327 | A * | 1/1990 | Malone et al. | 248/102 |
| 5,481,771 | A | 1/1996 | Burk, IV | |
| 5,809,594 | A * | 9/1998 | Isogai | 5/645 |
| D451,328 | S | 12/2001 | Kaiping | |
| 6,347,421 | B1 | 2/2002 | D'Emilio | |
| 6,363,557 | B2 * | 4/2002 | Chou | 5/645 |
| 6,681,944 | B1 | 1/2004 | Youssef et al. | |
| 2005/0261738 | A1 | 11/2005 | Garrett | |

FOREIGN PATENT DOCUMENTS

| | | |
|---|---|---|
| JP | 10-137093 | 5/1998 |

* cited by examiner

*Primary Examiner*—Michael Trettel
(74) *Attorney, Agent, or Firm*—Richard C. Litman

(57) ABSTRACT

The pillow with breasts is a pillow contoured to simulate human, female breasts and utilized to provide comfort for the user by minimizing the absence of a mother or loved one. The pillow may be positioned under the neck, head, behind the shoulders, or may be placed in any position that provides comfort to the user. A pocket is formed in the pillow for housing a nursing bottle.

8 Claims, 5 Drawing Sheets

PILLOW WITH BREASTS

CROSS-REFERENCE TO RELATED APPLICATION

This application claims the benefit of U.S. Provisional Patent Application Ser. No. 60/596,890, filed Oct. 27, 2005.

BACKGROUND OF THE INVENTION

1. Field of the Invention

The present invention generally relates to furnishings. More specifically, the present invention is drawn to a pillow structurally configured to simulate a portion of the human, female anatomy.

2. Description of the Related Art

There are many instances when the human psyche requires a familiar environment to feel comfortable and secure. This is true of adults and especially true of infants. The familiar hollows of a parent's lap or the contours of a mother's breast promote a sense of well-being that induces an aura of comfort. Unfortunately, parents cannot always be available to provide the nesting lap or breasts when the infant is fretful and in need of a familiar environment. At such times, a familiar pillow might suffice as a suitable substitute.

There is a need for a pillow that simulates the female chest. Thus, a pillow with breasts solving the aforementioned problems is desired.

SUMMARY OF THE INVENTION

The pillow with breasts of the present invention can provide comfort for the user in that it minimizes the absence of a mother or loved one. The pillow may be positioned under the neck, head, behind the shoulders, or may be placed in any position that provides comfort to the user.

As contemplated, the pillow will be available in conventional sizes (standard, queen, king) and utilize conventional and suitable coverings (cotton, silk, polyester, nylon, etc.). The top surface of the pillow is configured to simulate the anatomy of the human, female breast. Filling for the pillow can include any suitable materials that would create a desired consistency. Fill materials such as foam, silicon, microfiber beads, feathers, styrofoam, etc. are among the many suitable fill materials that could be employed.

A second embodiment provides an insulated pocket for housing a bottle. This embodiment can be utilized when the mother desires a break from nursing, transitioning from breast to bottle-feeding, or if the mother is no longer able to nurse for some reason.

Accordingly, the invention presents a pillow having an upper surface contoured to simulate the female breast(s) for providing comfort to a user.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
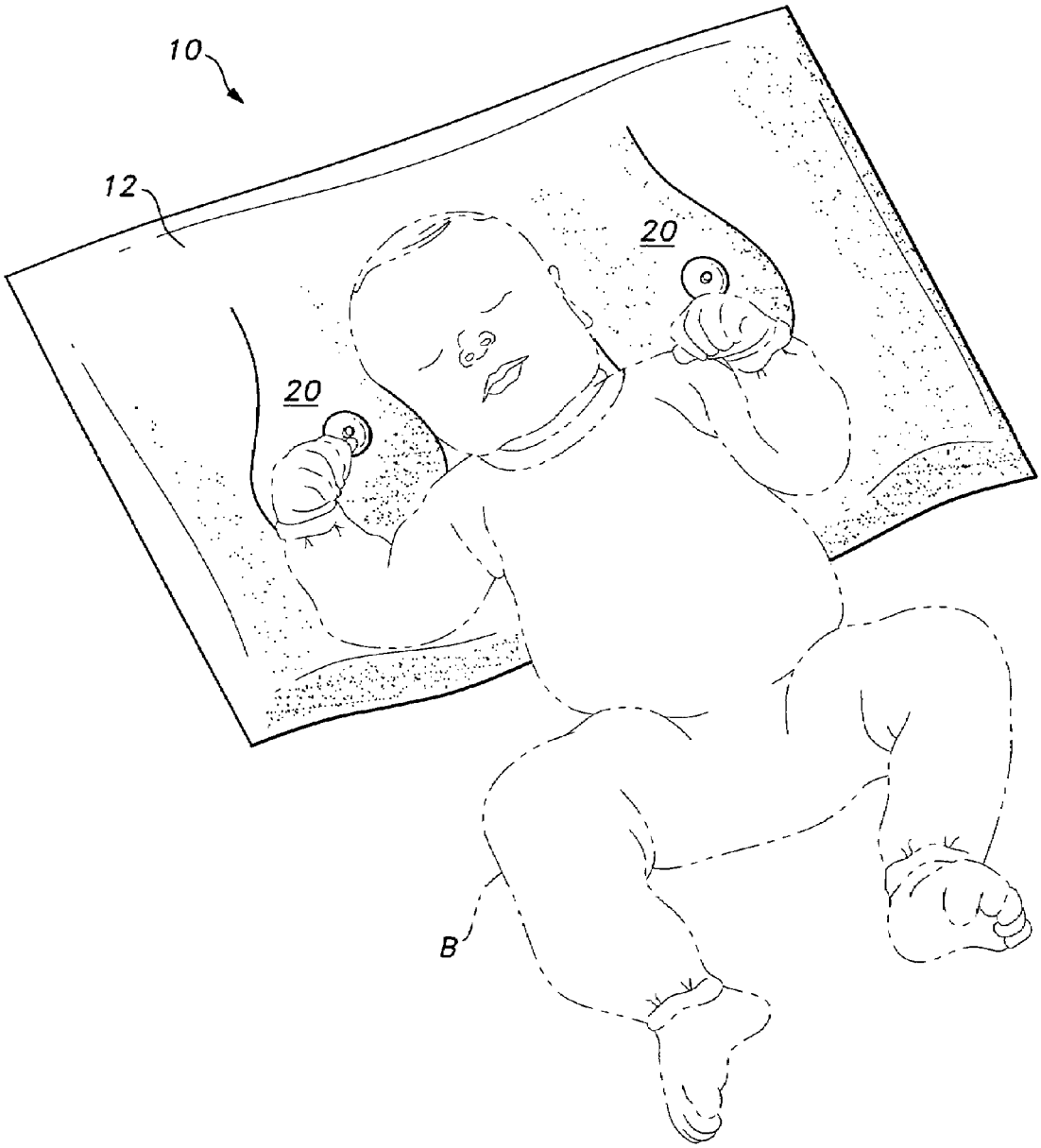
FIG. 1 is an environmental, perspective view of a pillow with breasts according to the present invention.
Figure 2:
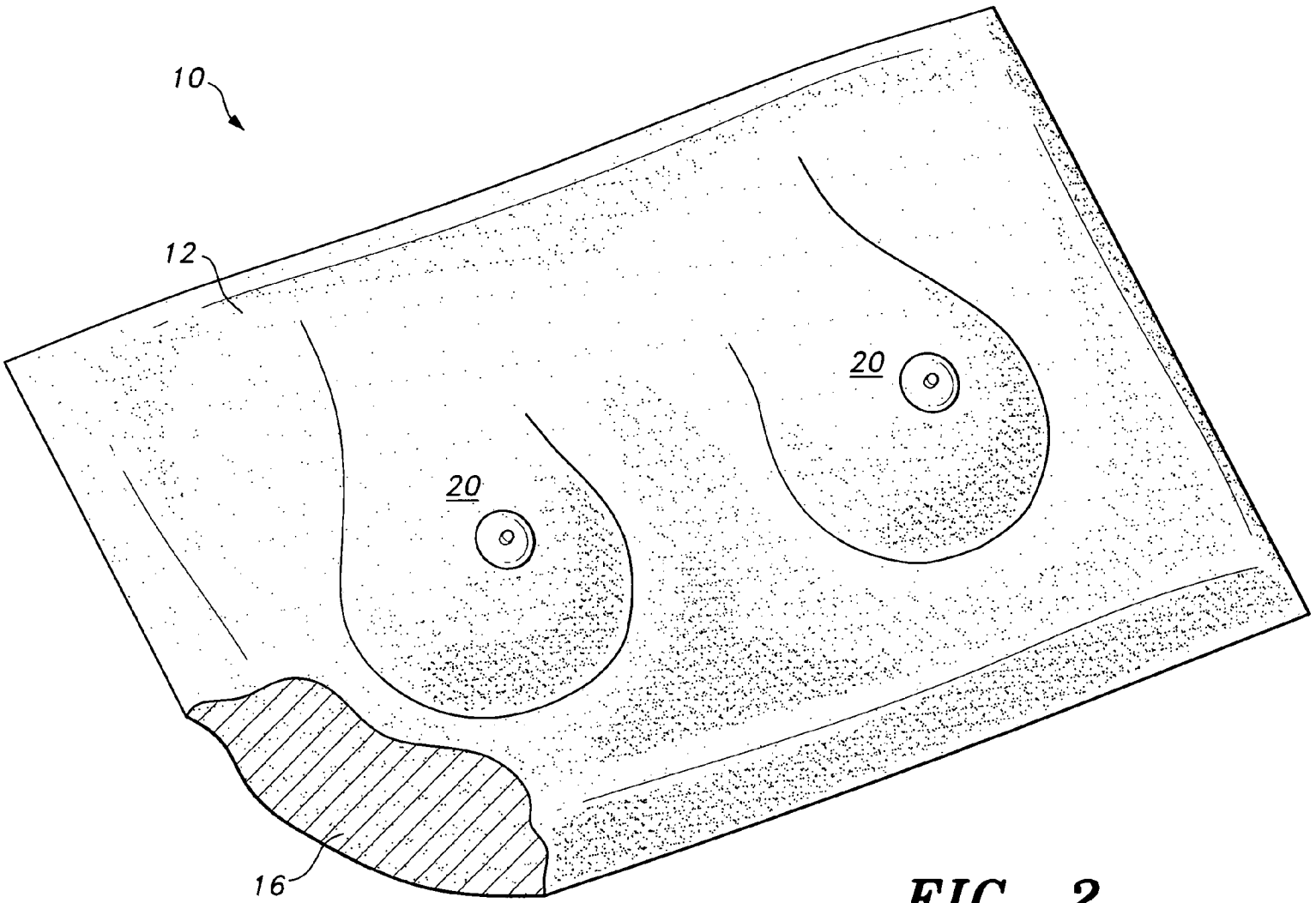
FIG. 2 is a perspective view pillow with breasts according to the present invention, broken away and partially in section.
Figure 3:
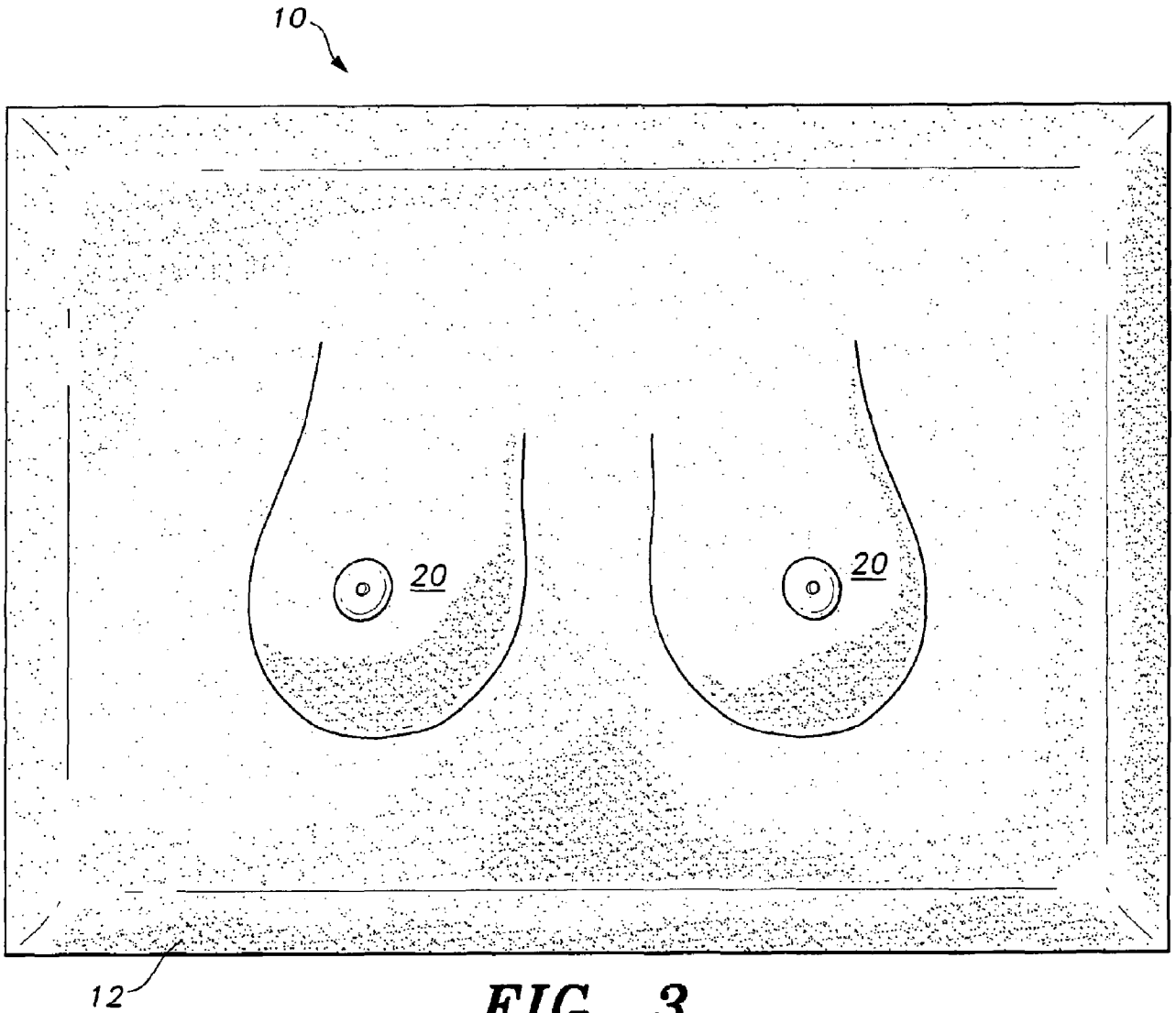
FIG. 3 is a top view of a pillow with breasts according to the present invention.
Figure 4:
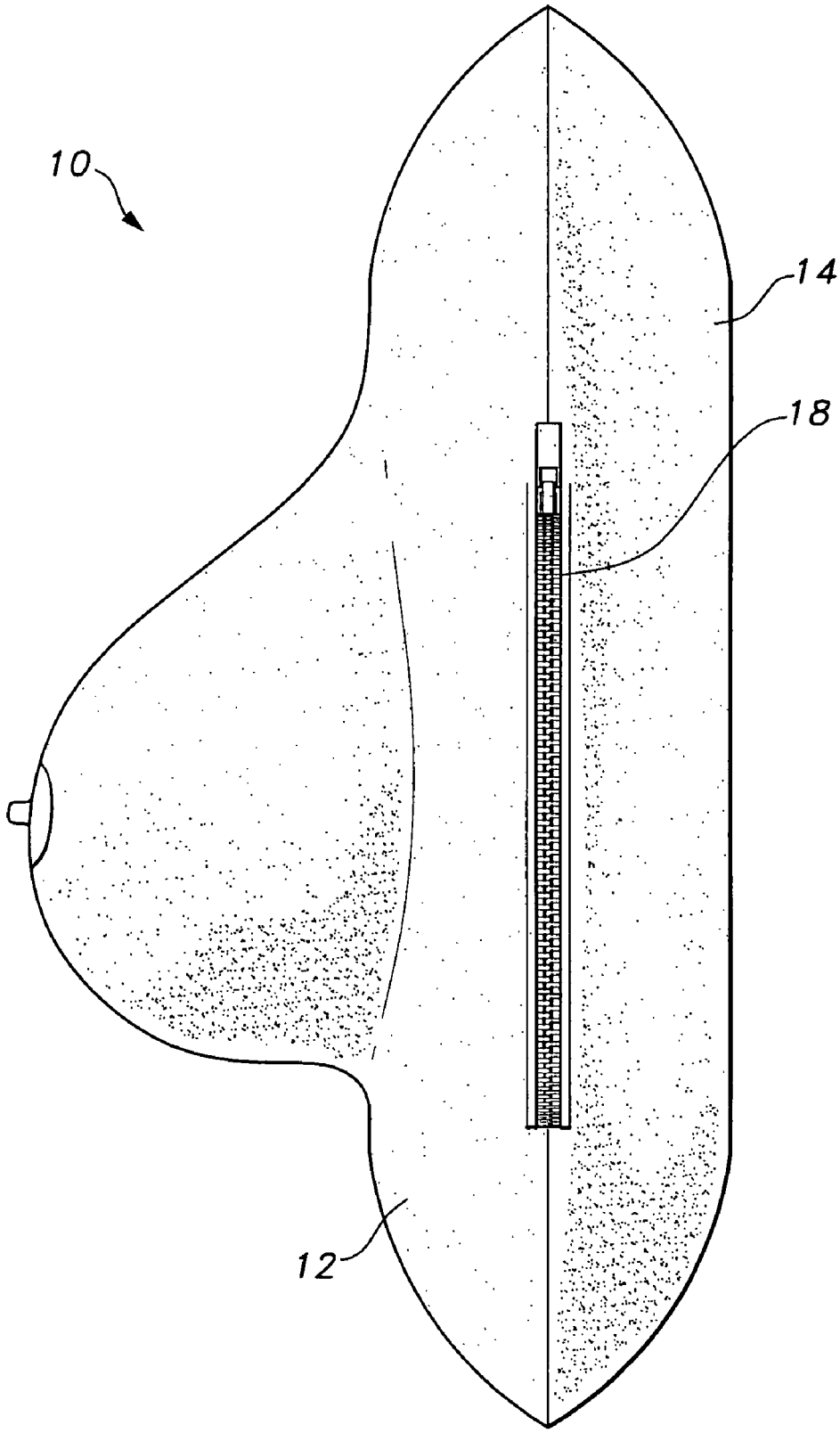
FIG. 4 is a side view of a pillow with breasts according to the present invention.

Attention is first directed to FIGS. 1-4 wherein the pillow with breasts of the present invention is generally indicated at 10. Pillow 10 comprises an upper surface 12 and an under surface 14. The surfaces are attached together along their edges to form a volume filled with a relatively soft pliable material 16. As noted above, surfaces 12 and 14 can be fabricated from a variety of known materials. Also noted above are examples of the many fill materials that can be utilized. At least one opening device 18 (zipper, buttons, hook-and loop fasteners, etc.) is arranged along one or more of the edges so that the fill material can be removed for laundering the pillow surfaces.

Upper surface 12 is contoured to simulate the look and feel of human, female breasts 20 when the pillow is filled with material 16. This allows a user, such as an infant B, to snuggle or nest on the pillow in a manner that is a reminder of the comforting feel of a mother's breasts.

Figure 5:
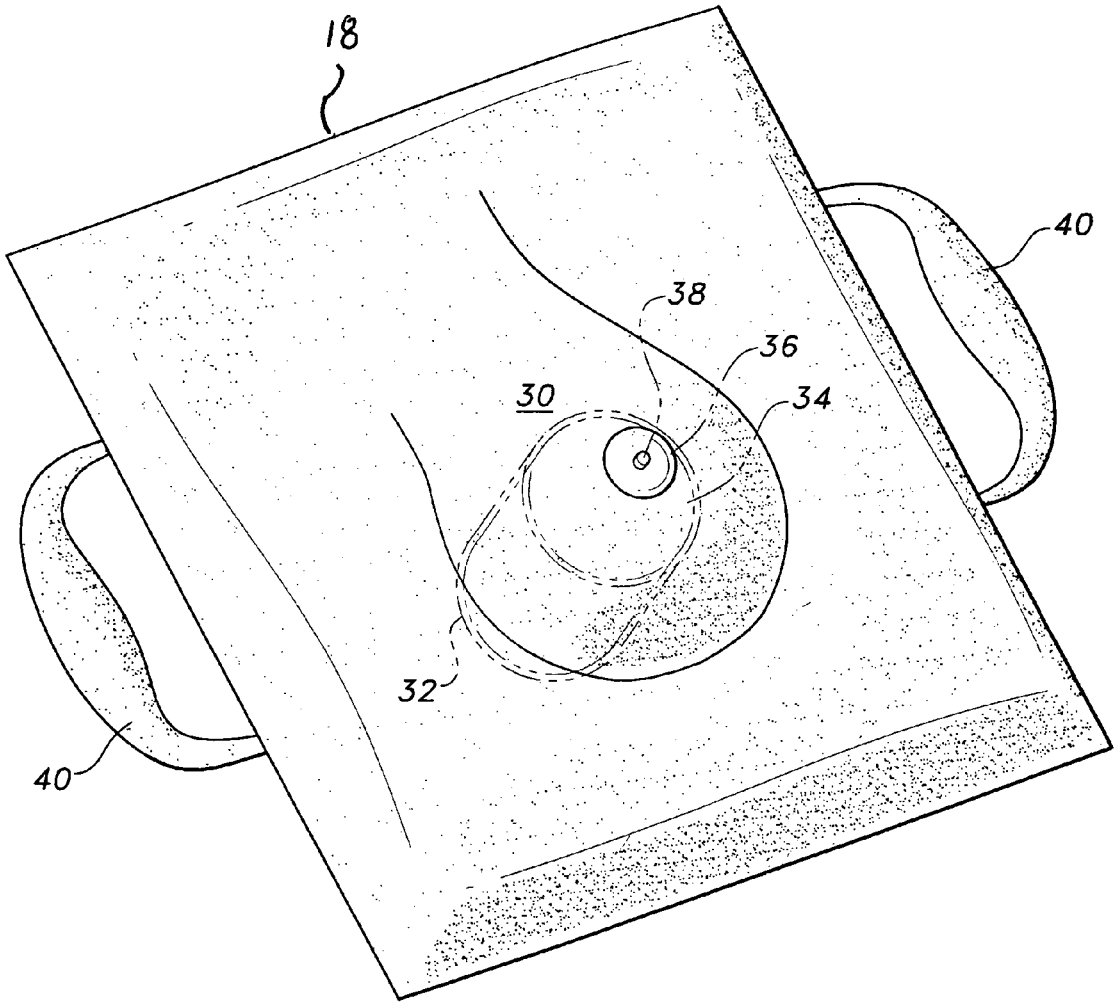
FIG. 5 is a perspective view of a second embodiment of a pillow with breasts according to the present invention.

As best seen in FIG. 5, a second embodiment of the comfort pillow comprises a pillow having an upper surface provided with only one simulated breast 30 formed thereon. Breast 30 is formed with a pocket 32 for housing a removable nursing bottle 34 therein. Bottle 34 is provided with a removable cap 36. Removable cap 36 has an opening or nipple 38, which nipple is designed to simulate the nipple of a mother's breast. Looped handles 40 are positioned on opposite sides of the pillow to allow the infant to grasp the pillow.

It is to be understood that the present invention is not limited to the embodiments described above, but encompasses any and all embodiments within the scope of the following claims.

I claim:

1. A pillow, comprising:

an upper surface having edges;

a lower surface having edges, the edges of said lower surface being attached to the edges of said upper surface thereby defining a volume between said upper surface and said lower surface;

a closable opening disposed on at least one of the attached edges;

a single, simulated human, female breast disposed on said upper surface;

a pocket formed in said breast;

a nursing bottle disposed in said pocket;

handles disposed on opposed edges of said pillow; and a fill material disposed in the volume defined between said upper surface and said lower surface.

2. The pillow according to claim 1, wherein said nursing bottle has an open top, the pillow further comprising a cap is selectively closing the open top of said bottle.

3. A pillow, comprising:

an upper surface having edges;

a lower surface having edges, the edges of said lower surface being attached to the edges of said upper surface thereby defining a volume between said upper surface and said lower surface;

a closable opening disposed on at least one of the attached edges;

a single, simulated human, female breast disposed on said upper surface;

a pocket formed in said breast;

a nursing bottle disposed in said pocket, said nursing bottle having an open top and a cap removably disposed on said open top;

handles disposed on opposed edges of said pillow; and a fill material disposed in the volume defined between said upper surface and said lower surface.

4. The pillow according to claim 3, further including a nipple disposed on said cap, said nipple simulating the nipple of the human female breast.

5. The pillow according to claim 4, wherein said upper surface and said lower surface are fabricated from a soft pliable material selected from the group consisting of cotton, silk, polyester and nylon.

6. The pillow according to claim 5, wherein said fill material is fabricated from material selected from the group consisting of foam, silicon, microfiber beads, feathers and styrofoam.

7. The pillow according to claim 6, further including an opening and closing device disposed on the closable opening.

8. The pillow according to claim 7, wherein said opening and closing device is selected from the group consisting of a zipper, buttons and hook-and loop fasteners.

* * * * *